United States Patent [19]

Wood

[11] Patent Number: 4,518,331

[45] Date of Patent: May 21, 1985

[54] PRESSURE LOADED GEAR PUMP

[75] Inventor: Robert S. Wood, Gosport, England

[73] Assignee: Plessey Overseas Limited, Ilford, England

[21] Appl. No.: 554,235

[22] Filed: Nov. 22, 1983

[30] Foreign Application Priority Data

Nov. 25, 1982 [GB] United Kingdom ..... 8233611

[51] Int. Cl.[3] ..... F04C 2/18; F04C 15/00

[52] U.S. Cl. ..... 418/132; 418/135

[58] Field of Search ..... 418/131, 132, 135

[56] References Cited

U.S. PATENT DOCUMENTS

| | | | |
|---|---|---|---|
| 2,817,297 | 12/1957 | Mosbacher | 418/132 |
| 3,029,739 | 4/1962 | Nagely | 418/132 |
| 3,294,028 | 12/1966 | Dahl | 418/135 |
| 3,597,131 | 8/1971 | Schofield et al. | 418/135 |
| 4,108,582 | 8/1978 | Bitton | 418/132 |

FOREIGN PATENT DOCUMENTS

| | | |
|---|---|---|
| 1005387 | 9/1965 | United Kingdom . |
| 1102998 | 2/1968 | United Kingdom . |
| 1127602 | 9/1968 | United Kingdom . |
| 1159707 | 7/1969 | United Kingdom . |
| 1269643 | 4/1972 | United Kingdom . |
| 1344100 | 1/1974 | United Kingdom . |

*Primary Examiner*—John J. Vrablik

*Attorney, Agent, or Firm*—Fleit, Jacobson, Cohn & Price

[57] ABSTRACT

A pressure loaded gear pump comprising a housing, a pair of intermeshing gears positioned in the housing, at least one gear side face sealing member, and pressure loading means for defining a pressure loaded area in use of the pump, the pressure loading means comprising a bobbin and first and second axial seals mounted on the bobbin.

8 Claims, 2 Drawing Figures

PRESSURE LOADED GEAR PUMP

Figure 1:
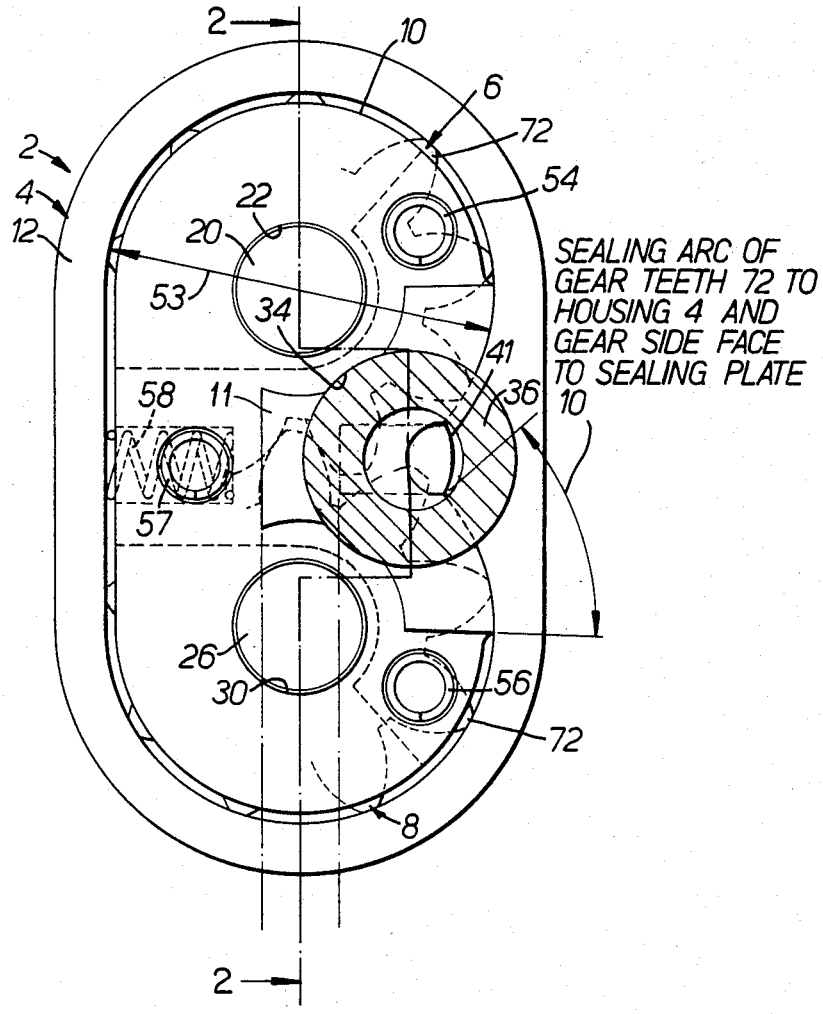

This invention relates to a pressure loaded gear pump.

Pressure loaded gear pumps are well known. The known pressure loaded gear pumps comprise a housing, a pair of intermeshing gears positioned in the housing, at least one gear side face sealing member, and a pressure loading means for defining a pressure loaded area in use of the pump. In the known gear pumps, the pressure loading means comprises a contoured relatively soft O-ring seal. The O-ring seals are employed to seal high pressure areas from low pressure areas in the pumps. The seals are usually sandwiched axially between pump bearings and end cover plates. With the O-ring seals, changes in the cross section of the seals can be effected by swelling or shrinking due to temperature changes or due to solvent effects of the fluids being pumped. These changes in turn adversely affect the ability of the O-ring seals to make good sealing connections. Also, the swelling can lead to an excessive clamping force loading the side plates onto the gears.

It is an aim of the present invention to provide a pressure loaded gear pump that is able to pump fluids that cannot normally be pumped by a pressure loaded gear pump employing an O-ring seal.

Accordingly, this invention provides a pressure loaded gear pump comprising a housing, a pair of intermeshing gears positioned in the housing, at least one gear side face sealing member, and pressure loading means for defining a pressure loaded area in use of the pump, the pressure loading means comprising a bobbin and first and second axial seals mounted on the bobbin.

The pressure loaded gear pump of the present invention may be able to maintain a high volumetric efficiency when pumping low viscosity fluids down to for example, one centistoke at moderate pressures of, for example, to 500 pounds per square inch. The pump can be designed to be able to pump solvents and oils that would degrade all commonly used elastomers forming O-ring seals in known pressure loaded gear pumps. The pressure loading enables a high volumetric efficiency to be attained over a working temperature range, and the pressure loading also compensates for effects of wear on the gear side faces.

The employment of the bobbin and the first and second axial seals permit the use of relatively stiff sealing materials for the seals if desired. A typical relatively stiff sealing material is polytetrafluoroethylene. The sealing materials will normally be chosen so that they are not adversely affected by the fluids that they are to pump, for example solvents and oils. Also with the employment of the bobbin and the first and second axial seals, changes in the dimensions of the seal may take place without adversely affecting the operation of the pump, i.e. by only causing a variation of the load of the seal radially.

Preferably, the pressure loaded gear pump is one in which the first seal is mounted in a bore in the housing, and in which the second seal is mounted in a bore which has substantially three quarters of its circumference in the gear side face sealing member and substantially one quarter of its circumference in the pump housing.

The first and second axial seals are preferably each a flexible seal which is substantially V-shaped in cross section. The V-shaped flexible seals preferably comprise a springy metal inner portion and a polytetrafluoroethylene outer covering.

The gear side face seal member may have a sealing surface in the form of a Y with curved arms.

Preferably, the centre of the bobbin substantially coincides with the centre of pressure afforded by the Y-shaped gear side face sealing member.

The pump may include a plurality of springs for providing an initial biasing load for biasing the gear side face sealing member axially onto the gears and transversely onto bores in the pump housing.

The pump may include a drive shaft and a drive seal on the drive shaft.

Usually, the shaft seal will be of the same construction as the first and second seals.

Figure 2:
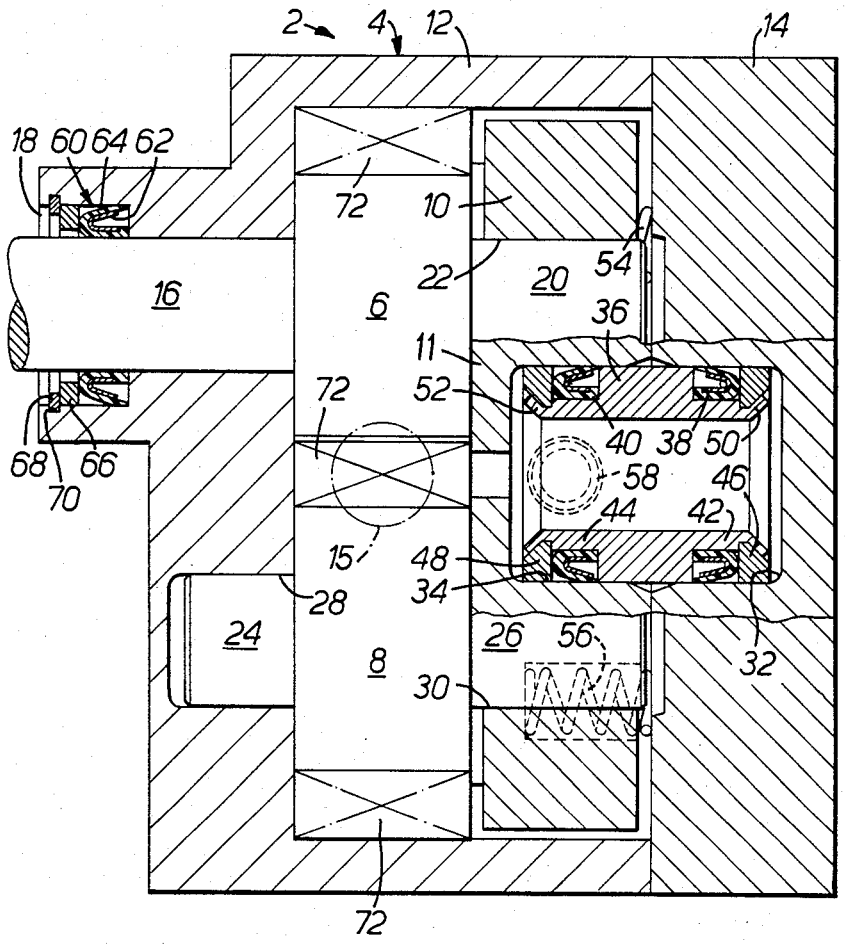

An embodiment of the invention will now be described solely by way of example and with reference to the accompanying drawings in which:

FIG. 1 is a transverse section through part of a pressure loaded gear pump in accordance with the invention; and FIG. 2 is an axial section through the gear pump shown in FIG. 1 and shows particularly a local cross section on the line 2—2 shown in FIG. 1.

Referring to the drawings, there is shown a pressure loaded gear pump 2 comprising a housing 4, a pair of intermeshing gears 6, 8 and a gear side face sealing member in the form of a sealing plate 10. The housing 4 comprises a body 12 and a cover 14. A typical position for an inlet or an outlet port of the gear pump 2 is shown by the port 15 in FIG. 2. Generally, the inlet and outlet ports can be sited in the sides or the ends of the gear pump 2.

The gear 6 is provided with a drive shaft 16 which passes as shown through a bore 18 in the housing 4. The side of the gear 6 remote from the drive shaft 16 is provided with an axle 20 which is supported in a bore 22 in the sealing plate 10 as shown. The gear 8 is provided with a pair of axles 24, 26 which are respectively located in a bore 28 in the housing 4 and a bore 30 in the sealing plate 10. As shown in FIG. 1, the face of the sealing plate 10 in contact with the side face of the gears is of substantially a Y-shape 11 and the arms of the Y are curved.

The cover 14 of the housing 4 is provided with a bore 32 and the gear pump 2 contains another bore 34, which bore 34 has substantially three quarters of its circumference in the sealing plate 10 and substantially one quarter of its circumference in the pump housing 4. Provided in the bores 32, 34 is a pressure loading means in the form of a bobbin 36 and first and second axial seals 38, 40 respectively. The bobbin 36 is hollow as shown and the seals 38, 40 are mounted on reduced diameter portions 42, 44 of the bobbin 36 as shown. Each seal 38, 40 is substantially V-shaped in cross-section and is provided with a springy metal inner portion and a polytetrafluoroethylene outer cover. It will be appreciated that the seals 38, 40 are flexible so that they can maintain contact with the walls of the bores 32, 34. It will be noticed that the bores 32, 34 are of the same diameter.

Washers 46, 48 are retained by spun-over lips 50, 52 respectively of the bobbin 36 to secure the seals 38, 40 in position.

In operation of the gear pump 2 as so far described, the sealing plate 10 with its Y-shape and curved arms functions to seal delivery pressure which fills the main part of the pump housing 4 from the space between the arms of the Y which is the inlet pressure area supplied from an inlet port 41. The outer curved surfaces of the sealing plate 10 are also in sealing contact with two bores in the pump housing 4 that house the pump gears 6, 8. One of these bores is indicated by the arrow 53 in FIG. 1.

Three springs 54,56,57 are used to provide an initial axial load in the direction of the drive shaft 16 onto the gears 6, 8. A further spring 58 is situated in the middle of the thickness of the sealing plate 10 and is used to provide a transverse load onto the bores in the pump body that house the gears 6, 8.

The bobbin 36 seals an area equal to that sealed by the Y-shaped sealing plate 10 so that the pressure forces loading the sealing plate 10 down onto the gears 6, 8 are balanced. The centre of the bobbin 36 is arranged to coincide approximately with the centre of pressure of the Y-shaped sealing area as indicated above.

Because the body of the gear pump 2 is filled with fluid at delivery pressure, it is appropriate to provide the drive shaft 16 with a shaft seal capable of withstanding this pressure on the drive shaft 16. The drive seal is illustrated in FIG. 2 as a drive seal 60. The drive seal 60 is of the same general construction as the seals 38, 40 so that it is substantially V-shaped in cross section and it has a spring metal inner portion 62 and an outer polytetrafluoroethylene cover 64. The drive seal 60 is held in position by a washer 66 which sits over the drive shaft 16 and which is held in position by a cir-clip 68. The cir-clip 68 fits in a groove 70 provided in the housing 4.

It is to be appreciated that the embodiment of the invention described above has been given by way of example only and that modifications may be effected. Thus, for example, more than two gears 6, 8 can be employed and banks of gears can be used if desired. The polytetrafluoroethylene can be replaced by another material and the pump could also be constructed to operate in the opposite direction by reversing the rotation of the drive shaft 16. In this latter instance, the drive shaft would then be at inlet pressure and the side loading spring or springss 58 would need to be strong enough to maintain the sealing plate 10 in contact with the bores in the housing 4 containing the gears 6, 8. In an alternative construction, non-sealing parts of the sealing plate 10 would have to be extended to provide locations to maintain the close clearance required at the sealing sector.

The Y-shaped sealing plate 10 is shown as forming part of a normal figure-8 pump bearing supporting the gear journals for receiving the gear axles. Such a design is not essential and the gear axles could be supported by other means such for example as in block member. The sealing plate 10 need only extend to encompass the bobbin 36 on one side and to cover the required arc of contact against the gear side faces and also against the bores in the pump body that house the gears 6, 8. Further, the number of springs 54,56,57 employed to provide the initial axial load is not critical and more or less than the illustrated three springs can be employed.

I claim:

1. A pressure loaded gear pump comprising a housing defining a cavity therein, a pair of intermeshing gears positioned in the cavity, at least one gear side face sealing member positioned in the cavity between the gears and the housing, and pressure loading means, for defining a pressure loaded area in the use of the pump, including a bobbin having first and second axial seals mounted thereon, wherein the bobbin is positioned within the housing such that the first seal is located in a bore defined in the housing and the second seal is located in a bore having substantially three quarters of its circumference defined by the gear face sealing member and substantially one quarter of its circumference defined by the housing.

2. A pressure loaded gear pump according to claim 1 in which the first and second axial seals are each a flexible seal which is substantially V-shaped in cross section.

3. A pressure loaded gear pump according to claim 2 in which the V-shaped flexible seals comprise a springy metal inner portion and a polytetrafluoroethylene outer covering.

4. A pressure loaded gear pump according to claim 2 in which the gear side face sealing member is provided with a sealing surface in the form of a Y with curved arms, the sealing surface affording a centre of pressure in use of the pump.

5. A pressure loaded gear pump according to claim 4 in which the bobbin is positioned in the housing such that the axis of the bobbin coincides with the centre of pressure afforded by the Y-shaped sealing surface on the gear side face sealing member.

6. A pressure loaded gear pump according to claim 4 or claim 6 and including a plurality of springs located within the housing and acting on the gear side face sealing member to bias the gear side face sealing member axially into engagement with the gears and transversely into engagement with bores provided in the cavity within the pump housing.

7. A pressure loaded gear pump according to claim 6 in which one of the intermeshing gears is provided with a drive shaft extending through a bore in the housing and the drive shaft is provided with a shaft seal which engages the wall of the bore in the housing through which the drive shaft extends.

8. A pressure loaded gear pump according to claim 7 in which the shaft seal is of the same construction as the first and second axial seals provided on the bobbin.

* * * * *